US007338414B1

(12) United States Patent
Hsiung

(10) Patent No.: US 7,338,414 B1
(45) Date of Patent: Mar. 4, 2008

(54) APPARATUS TO ENABLE A USER TO SIMULATE SKATING

(75) Inventor: Bob Hsiung, Walnut, CA (US)

(73) Assignee: Hupa International, Inc., Walnut, CA (US)

( * ) Notice: Subject to any disclaimer, the term of this patent is extended or adjusted under 35 U.S.C. 154(b) by 401 days.

(21) Appl. No.: 11/082,279

(22) Filed: Mar. 16, 2005

(51) Int. Cl.
*A63B 22/14* (2006.01)
*A63B 69/18* (2006.01)

(52) U.S. Cl. ..... 482/71; 482/51; 482/66; 482/70

(58) Field of Classification Search ..... 482/51, 482/52, 66, 70, 71, 121, 147; 434/253; 601/23; 280/842
See application file for complete search history.

(56) References Cited

U.S. PATENT DOCUMENTS 6,849,032 B2 * 2/2005 Chu ..... 482/51
7,115,073 B2 * 10/2006 Nizamuddin ..... 482/51

* cited by examiner

*Primary Examiner*—Ehud Gartenberg
*Assistant Examiner*—Oren I Ginsberg
(74) *Attorney, Agent, or Firm*—Thomas I. Rozsa

(57) ABSTRACT

An improved apparatus to enable a user to simulate skating, hereafter referred to as a skating machine, wherein the improvement involves the incorporation of a tension means connected at one end to the location of the intersection of a pedal connector bar and a crank to prevent the skating machine from locking or freezing when the pedals are at their most sideways positions. The crank is connected at its opposite end to a resistance means and the pedal connector bar is connected at its opposite end to a portion of a pedal assembly. The tension means is connected at its opposite end to a location on the skating machine frame. The crank and pedal connector bar are aligned in an almost horizontal 180 degree position when the pedals are at their extreme left or right position and the tension means prevents the machine from locking in this position.

30 Claims, 12 Drawing Sheets

APPARATUS TO ENABLE A USER TO SIMULATE SKATING

BACKGROUND OF THE INVENTION

1. Field of the Invention

The present invention relates to exercise apparatus, and more particularly to a specific type of exercise apparatus which enables a user to simulate skating.

2. Description of the Prior Art

In general, apparatus which enables a user to simulate skating, known as a skating machine, has been known in the prior art. However, prior art skating machines suffer from one critical design defect. In prior art skating machines, the apparatus by which the skating foot pedal moves side to side is a double crank apparatus which is not restrained in any manner in the longitudinal direction. As a result, the double crank can be rotated to a point where the two cranks are at 180 degrees to each other which creates a "dead" angle so that the two cranks lock in place and the skating machine is "frozen". There is a significant need for an improved design for a skating machine which eliminates the "dead" angle and eliminates the skating machine being "frozen" during its operation.

SUMMARY OF THE INVENTION

The present invention is an improved apparatus to enable a user to simulate skating, hereafter referred to as a skating machine, wherein the improvement involves the incorporation of a tension means connected at one end to the location of the intersection of a pedal connector bar and a crank to prevent the skating machine from locking or freezing when the pedals are at their most sideways positions. The crank is connected at its opposite end to a resistance means and the pedal connector bar is connected at its opposite end to a portion of a pedal assembly. The tension means is connected at its opposite end to a location on the skating machine frame. The crank and pedal connector bar are aligned in an almost horizontal 180 degree position when the pedals are at their extreme left or right position and the tension means prevents the machine from locking in this position.

It has been discovered, according to the present invention, that the crank and pedal connector bar of a skating machine lock when the pedals of the skating machine are at the most extreme left or right position and the incorporation of a source of tension at the intersection of the crank and pedal connector bar will prevent locking and result in a smooth skating action.

It is therefore an object of the present invention to provide a skating machine which will not lock and will provide a smooth skating action from extreme left to extreme right.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Figure 1:
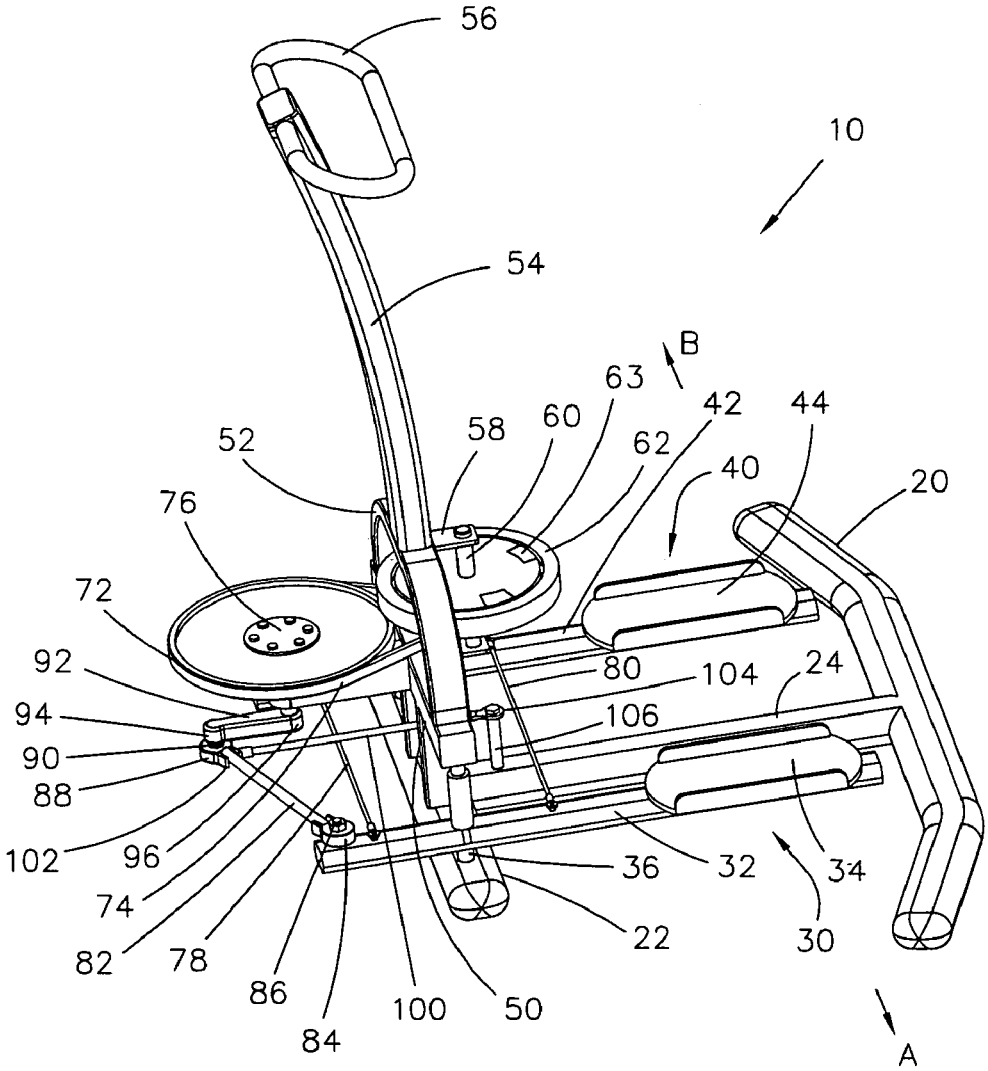
FIG. 1 is a perspective view of the preferred embodiment of the present invention skating machine.
Figure 2:
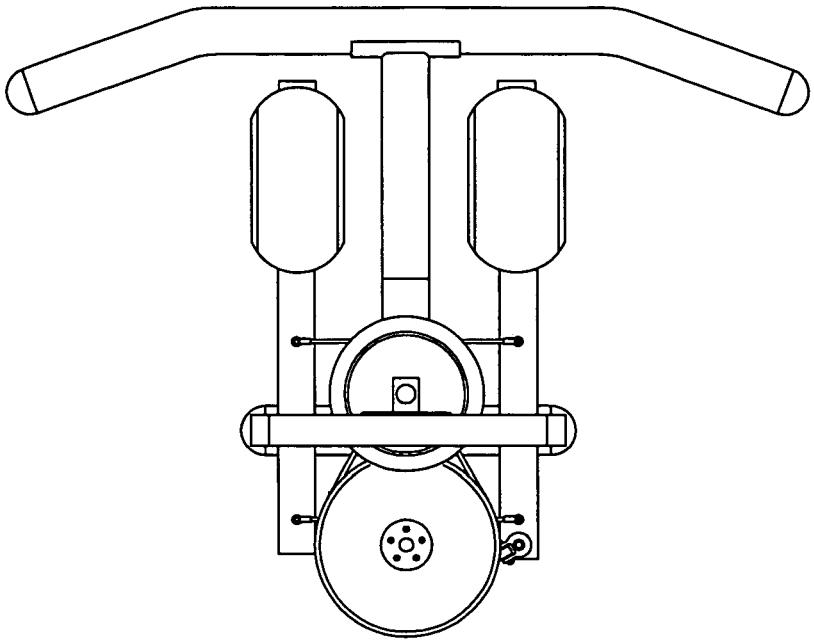
FIG. 2 is a plan view of the skating machine illustrated in FIG. 1 with the handle bar assembly removed.
Figure 3:
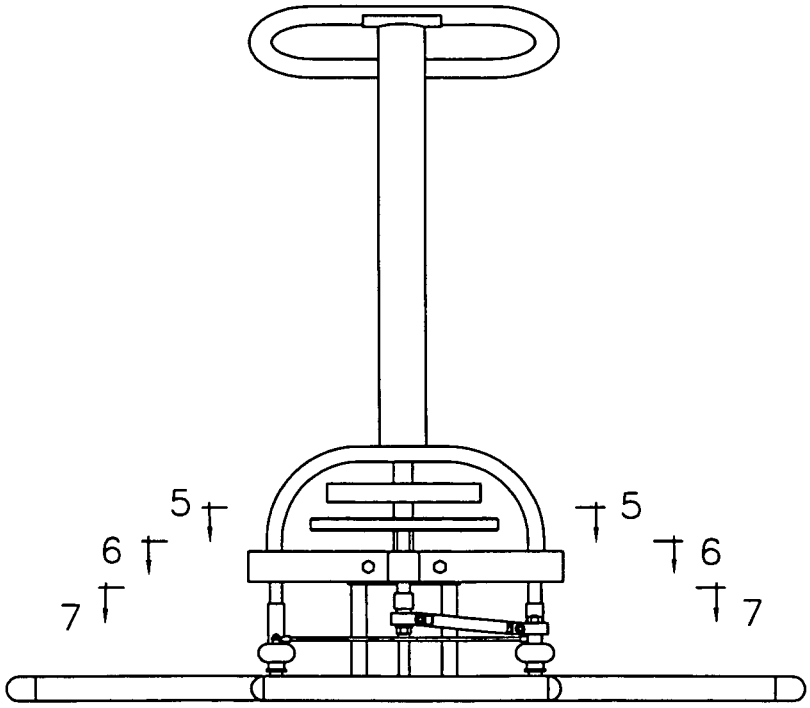
FIG. 3 is a front elevational view of the embodiment of the skating machine illustrated in FIG. 1.
Figure 4:
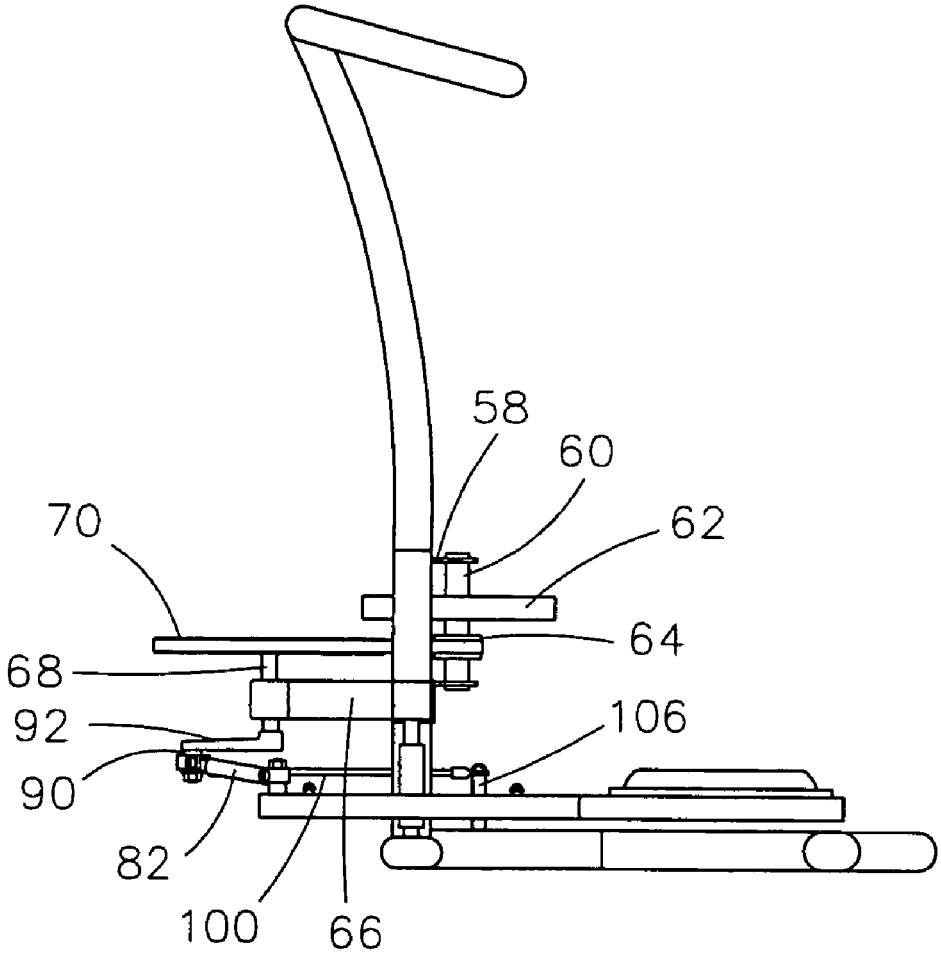
FIG. 4 is a side elevational view of the embodiment of the skating machine illustrated in FIG. 1.
Figure 5:
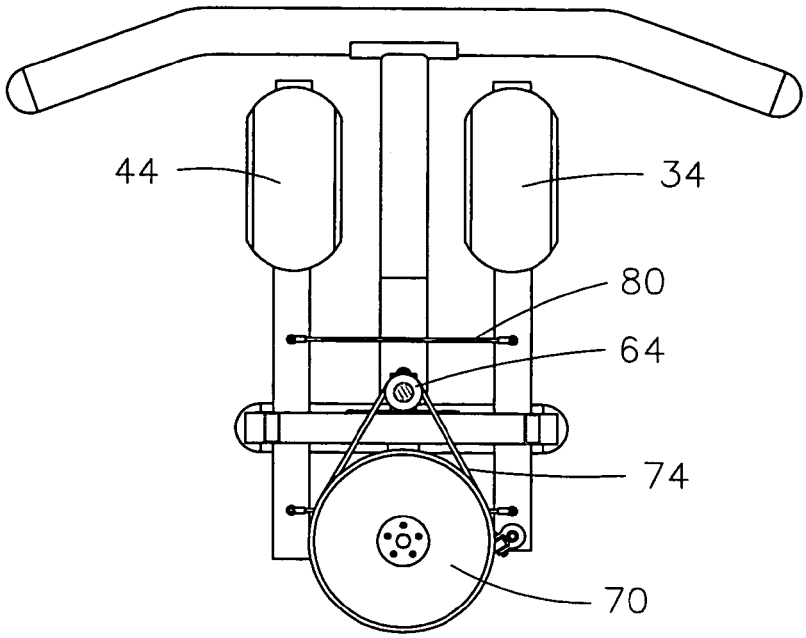
FIG. 5 is a cross-sectional view of the skating machine as it would be seen along Line 5-5 of FIG. 3.
Figure 6:
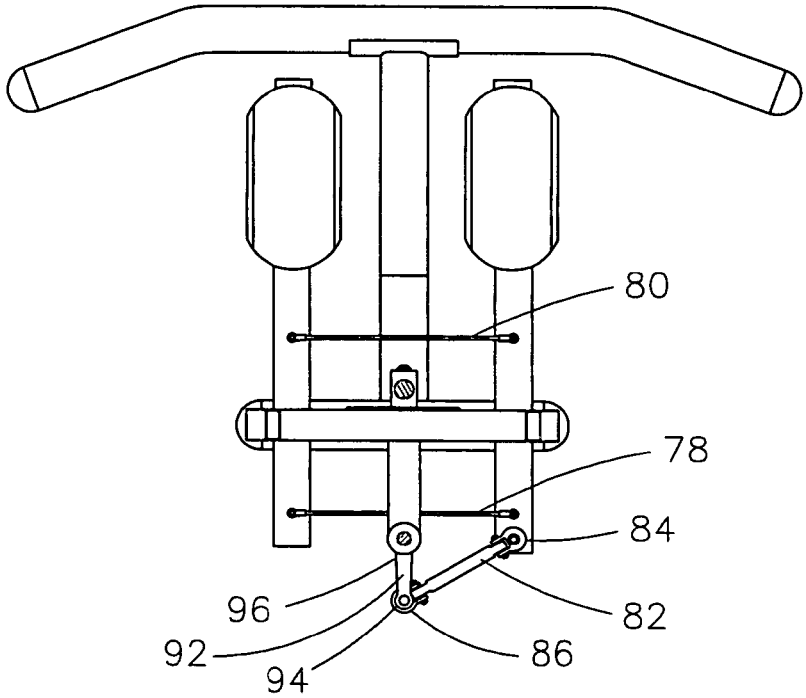
FIG. 6 is a cross-sectional view of the skating machine as it would be seen along Line 6-6 of FIG. 3.

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Referring to FIGS. 1 through 13, there is illustrated the preferred embodiment of the present invention apparatus to enable a user to simulate skating which will hereinafter be referred to as a skating machine 10. The skating machine 10 is supported on a rear transverse frame 20, and a front transverse frame 22 which are interconnected by a longitudinal frame 24. The skating machine 10 further comprises a first pedal assembly 30 having a first longitudinal pedal bar 32 to which a first foot pedal 34 is connected. The first longitudinal pedal bar 32 is rotatably connected to the front transverse frame 22 by a first rod 36. The skating machine 10 further comprises a second pedal assembly 40 having a second longitudinal pedal bar 42 to which a second foot pedal 44 is connected. The second longitudinal pedal bar 42 is rotatably connected to the front transverse frame 22 by a second rod 46.

First and second foot pedal assemblies 30 and 40 are spaced apart and side-by-side to each other and located along opposite sides of longitudinal frame 24. Rods 36 and 46 are also connected to an upper transverse frame 50 which supports a semicircular frame 52 to which is connected a handle post 54 which supports a handlebar 56. A pair of identical upper and lower rearward and longitudinal bars 58 are respectively located, wherein the upper one is positioned on the semicircular frame 50 and the lower bar is positioned on the upper transverse frame 50. The paired bars 58 through a connecting rod of flywheel axle 60 rotatably support a flywheel 62. The flywheel 62 is connected to a collar or pulley 64 so that the collar or pulley 64 will rotate with the flywheel 62.

A forward bar 66 is supported on transverse frame 50 and through a connecting rod or pulley axle 68 rotatably supports a pulley wheel 70 which has a circumferential channel 72 into which is supported a connecting band 74. The connecting band 74 also is connected to collar or pulley 64, and as the pulley wheel 70 rotates, the flywheel 62 also rotates. The pulley wheel 70 is connected to the connecting rod 68 by mounting bracket 76. The purpose of the flywheel 62 is to add resistance to the rotation of the pulley wheel 70. By way of example only, the flywheel 62 can be a weighted magnetic flywheel having a multiplicity of magnets 63.

The new innovative features of the present invention skating machine 10 will now be described. The first and second longitudinal pedal bars 32 and 42 are interconnected adjacent their front ends by a first flexible cable 78 located in front of front transverse frame 22 and by a second flexible and inextensible cable 80 located adjacent a portion of the longitudinal pedal bars 32 and 42 positioned behind front transverse frame 22.

An elongated pedal connector bar 82 is rotatably connected at its first end 84 to the front of the first longitudinal pedal bar 32 by rod means 86 and is rotatably connected at its second end 88 to crank axle 90. A crank 92 is connected at its first end 94 to the crank axle 90 and connected at its second end 96 to the connecting rod or pulley axle 68 to which the pulley wheel 70 is also connected. A key innovation of the present invention skating machine 10 is the addition of a resilient tension means 100 which by way of example can be a bungee cord. The resilient tension means 100 is connected at one end 102 to the crank axle 90 and is connected at its opposite end 104 to a post 106 which is connected at its opposite end to longitudinal frame 24. The preferred embodiment as illustrated in FIGS. 1 to 13 has the post 106 connected to the longitudinal frame 24 at a location behind front transverse frame 22. It is also within the spirit and scope of the present invention to have the post 106 connected at other locations on the skating machine—by way of example, to the front transverse frame 22. The addition of the stretchable tension means or bungee cord 100 is a key innovation because it prevents the pedal connector bar 82 and crank 92 from locking at a "dead" angle when they are aligned to thereby prevent the skating machine 10 from being "frozen". The stretchable tension means 100 permits a continuous fluid motion as the user skates side to side on the skating machine 10.

Figure 9:
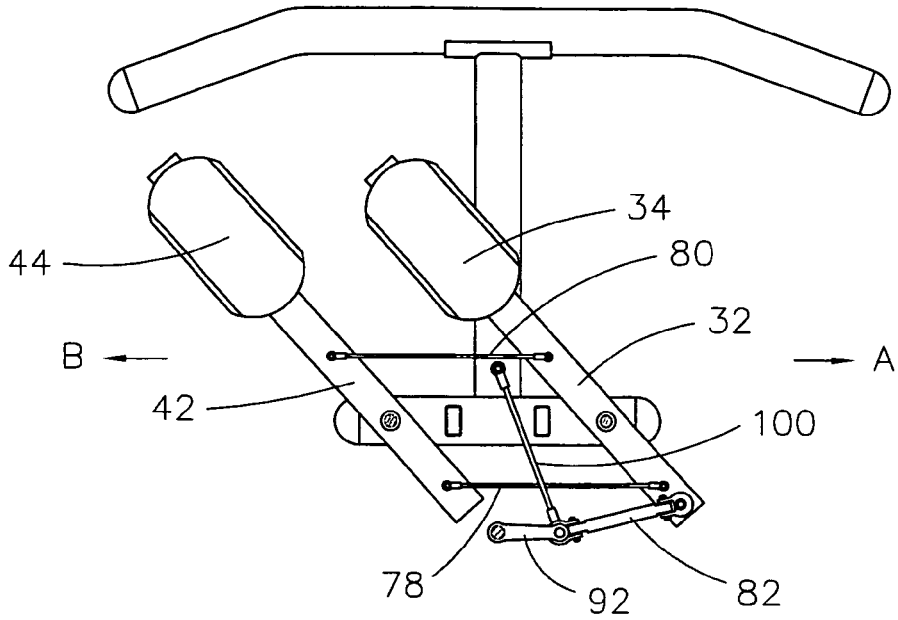
FIG. 9 is a cross-sectional view of the skating machine as it would be seen along Line 7-7 of FIG. 3 with the crank rotated 90 degrees counterclockwise.
Figure 12:
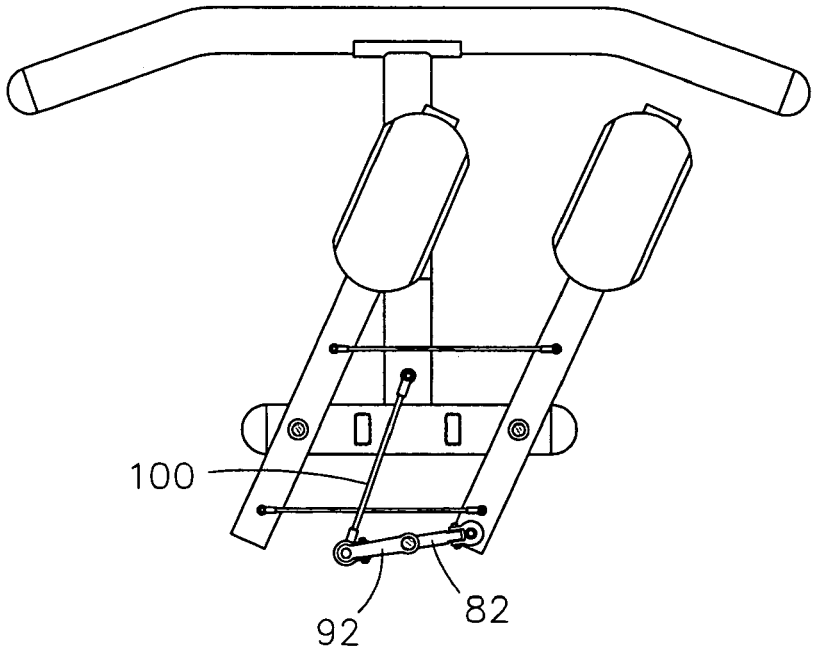
FIG. 12 is a cross-sectional view of the skating machine as it would be seen along Line 7-7 of FIG. 3 with the crank rotated to a position where its long axis is collinear with the connecting rod.
Figure 13:
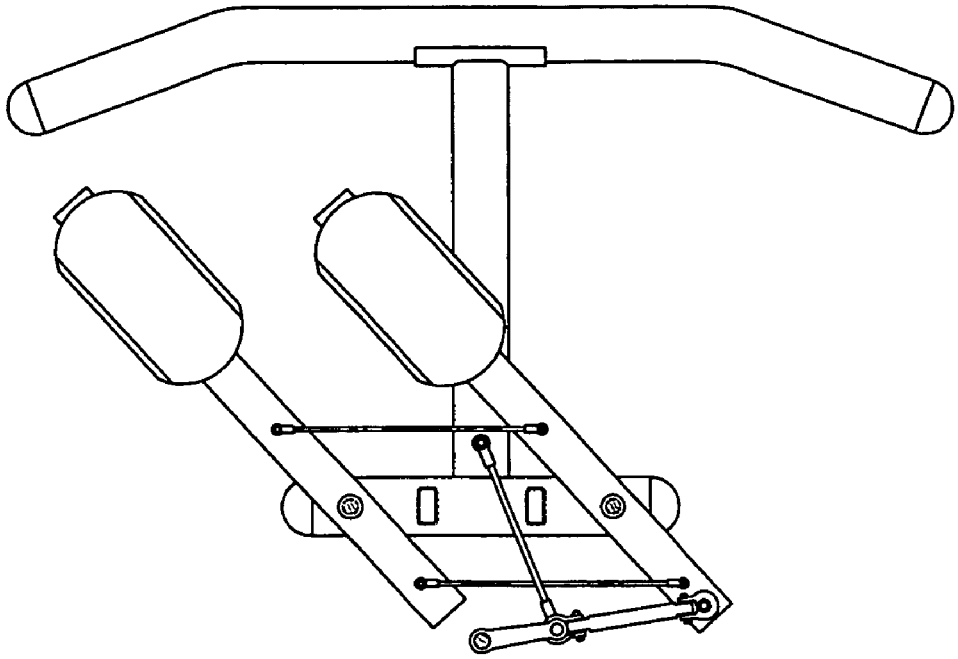
FIG. 13 is a cross-sectional view of the skating machine as it would be seen along Line 7-7 of FIG. 3 with the crank rotated 180 degrees from its positioning in FIG. 12 to a second position where the long axis of the crank is collinear with the connecting rod.

The operation of the skating machine 10 will now be described. A user stands on the skating machine 10 so that the user's left foot rests in first foot pedal 34 and the user's right foot rests in second foot pedal 44. The user holds onto handlebar 56. The user causes the pedals to move sideways to the left in the direction of arrow A and then back in the other sideways direction or to the right in the direction of arrow B. Referring to FIG. 9, the user has caused the first pedal assembly 30 and second pedal assembly 40 to be rotated to the right in the direction of arrow B. The crank 92 is rotated 90 degrees counterclockwise from its position in FIG. 7. Referring to FIG. 12, the user has caused the pedal assemblies to be rotated to the left to a position where crank 92 is aligned with bar 82. Resilient tension means or bungee cord 100 prevents the crank 92 and pedal connector bar 82 from locking or freezing at this position. FIG. 13 shows the user having caused the pedal assemblies to have moved to the right so that the crank 92 and pedal connector bar 82 are once again aligned and once again the resilient tension means or bungee cord 100 prevents the crank 92 and pedal connector bar 82 from locking or freezing at this position. The flexible and inextensible cables 78 and 80 assure that first longitudinal pedal bar 32 and second longitudinal bar 42 move together in synchronization.

It will also be appreciated that while two flexible and inextensible cables 78 and 80 were illustrated in the preferred embodiment, it is also within the spirit and scope of the present invention to have at least one flexible and inextensible cables either 78 or 80, and positioned anywhere along the lengths of longitudinal pedal bars 32 and 42.

Figure 7:
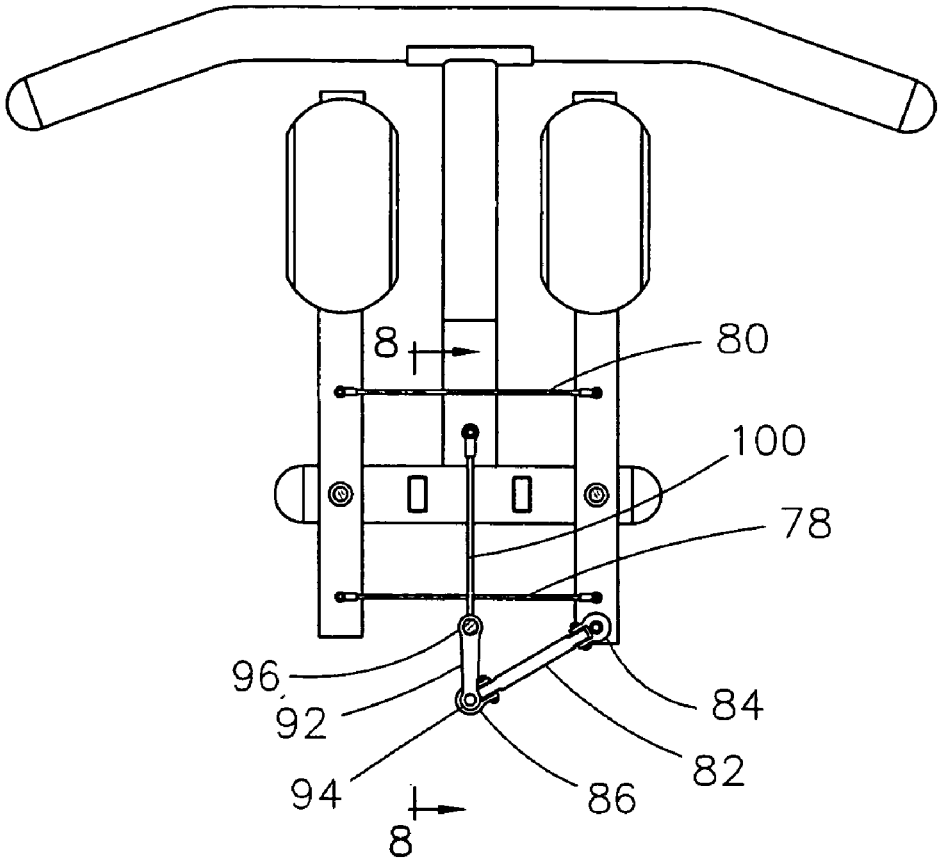
FIG. 7 is a cross-sectional view of the skating machine as it would be seen along Line 7-7 of FIG. 3.
Figure 8:
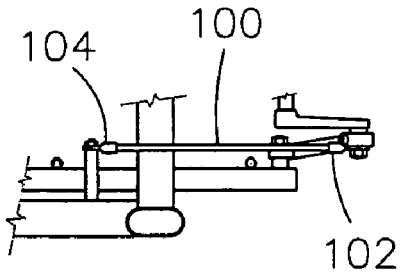
FIG. 8 is a cross-sectional view (rotated 90 degrees counterclockwise) of the skating machine as it would be seen along Line 8-8 of FIG. 7.
Figure 10:
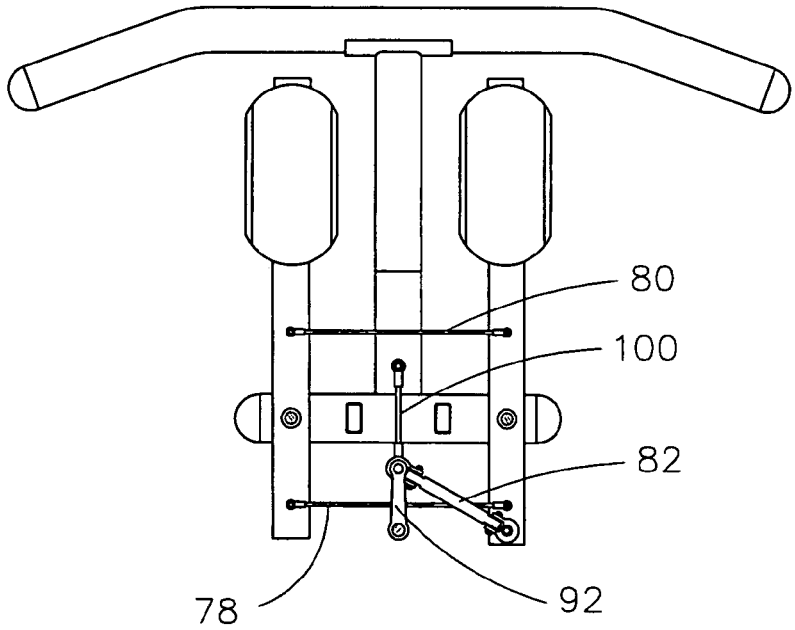
FIG. 10 is a cross-sectional view of the skating machine as it would be seen along Line 7-7 of FIG. 3 with the crank rotated 180 degrees counterclockwise.
Figure 11:
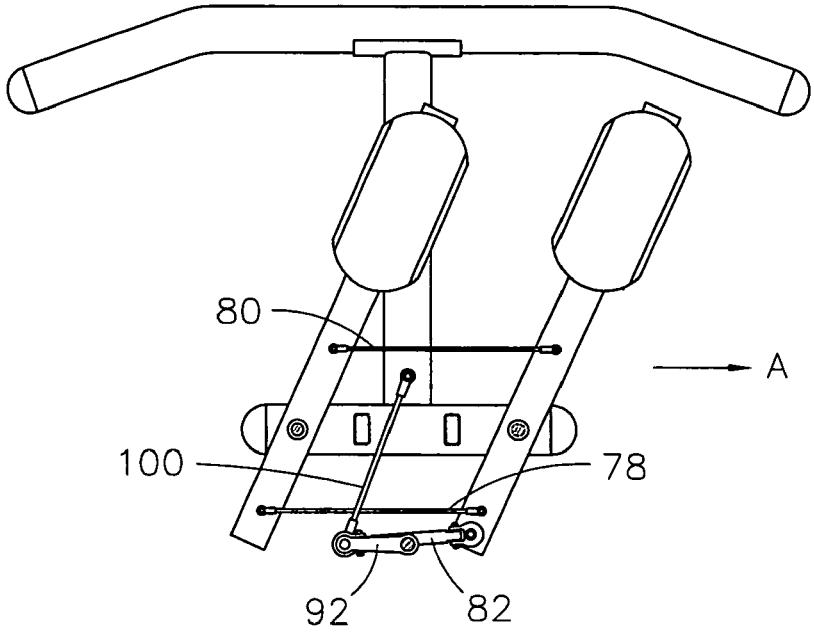
FIG. 11 is a cross-sectional view of the skating machine as it would be seen along Line 7-7 of FIG. 3 with the crank rotated 270 degrees counterclockwise.

Referring to FIG. 10, the user has now skated to the left so that the pedal assemblies 30 and 40 are in their standing position with crank 92 rotated 90 degrees clockwise from its position in FIG. 9 or 180 degrees counterclockwise from its position in FIG. 7. FIG. 11 shows the user having caused the pedal assemblies to have moved to the left with the crank 92 rotated 90 degrees clockwise from its position in FIG. 10. Referring to FIG. 12, the user has caused the pedal assemblies to be rotated to the left to a position where crank 92 is aligned with bar 82. Resilient tension means or bungee cord 100 prevents the crank 92 and pedal connector bar 82 from locking or freezing at this position. FIG. 13 shows the user having caused the pedal assemblies to have moved to the right so that the crank 92 and pedal connector bar 82 are once again aligned and once again the resilient tension means or bungee cord 100 prevents the crank 92 and pedal connector bar 82 from locking or freezing at this position. The flexible and inextensible cables 78 and 80 assure that first longitudinal pedal bar 32 and second longitudinal bar 42 move together in synchronization. It can be seen from FIGS. 12 through 13 that the crank 92 and pedal connector bar 82 are aligned when the pedal assemblies 30 and 40 have been rotated to their outermost left and right positions. The problem with prior art skating machines is that it is in this position that the skating machine "locks" or "freezes". The addition of the flexible resilient tension means 100 prevents the "locking" or "freezing" from occurring.

As the side to side motion is taking place, the pulley wheel 70 is rotating and resistance is provided by the interconnected flywheel 62 which is also rotating due to the interconnecting band 74 connecting the pulley wheel 70 to the pulley 64 of the flywheel 62. A resistance variation means connected to the flywheel 62 permits the user to increase or decrease the amount of resistance created by the flywheel 62.

Figure 14:
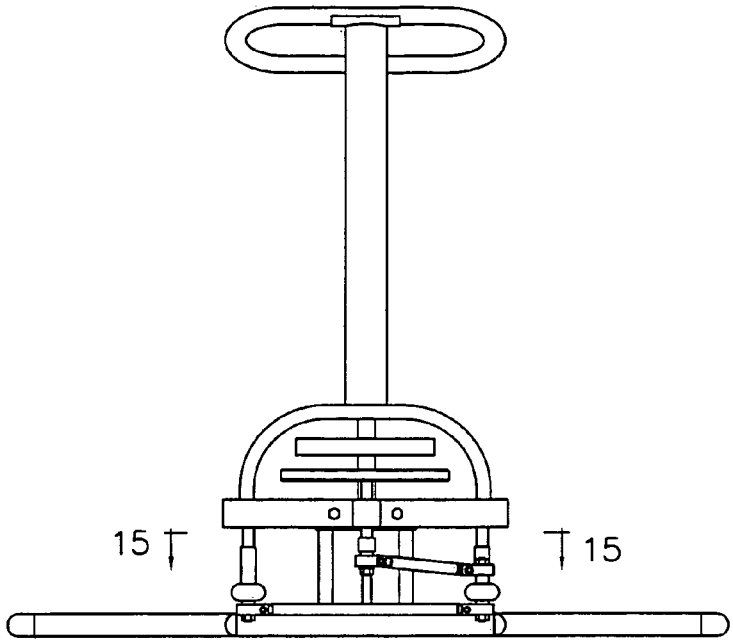
FIG. 14 is a front elevational view of an alternative embodiment of the skating machine.
Figure 15:
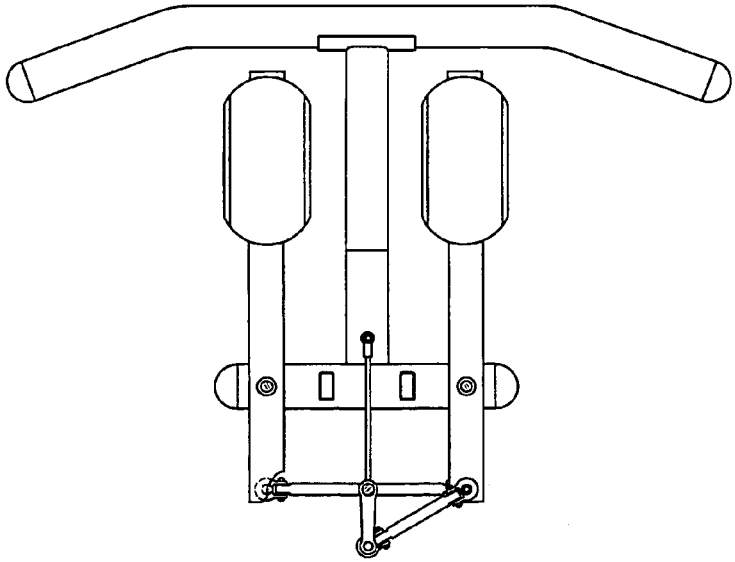
FIG. 15 is a cross-sectional view of the skating machine as it would be seen along Line 15-15 of FIG. 14.

An alternative embodiment of the skating machine 10A is illustrated in FIGS. 14 and 15. The only difference in the alternative embodiment illustrated in FIGS. 14 and 15 is a change in the pedal assembly transverse interconnecting means. In the preferred embodiment, the pedal assembly transverse interconnecting means were the pair of flexible and inextensible cables 78 and 80. In the alternative embodiment the flexible and inextensible cables 78 and 80 have been replaced with a transverse rod 120 rotatably affixed adjacent to the respective front ends of first longitudinal pedal bar 32 and second longitudinal pedal bar 42.

Through use of the present invention, an improved skating machine is provided with a smooth side to side skating action which will not lock or freeze at the extreme left or right sideways position. While the skating machine 10 has been illustrated with a maximum side to side angle of approximately 45 degrees, it will be appreciated that the angle can be increased to any larger desired angle by increasing the length of pedal connector bar 82. The angle can be decreased by decreasing the length of pedal connector bar 82. It will also be appreciated that the opposite end of the tension means 100 remote from the intersection of the crank 92 and the pedal connector bar 82 can be attached at any desired location on a portion of the frame of the skating machine.

Figure 16:
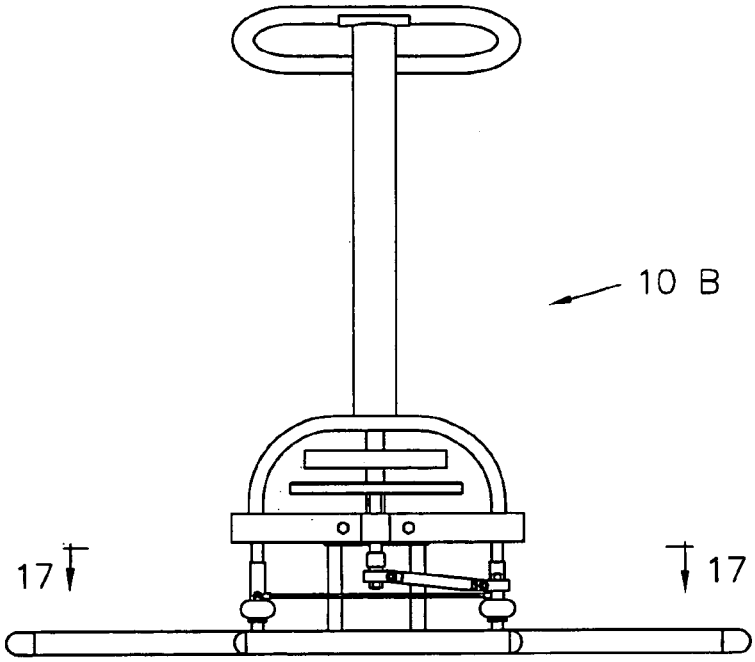
FIG. 16 is a front elevational view of another alternative embodiment of the present invention where the resilient tension means has been eliminated.
Figure 17:
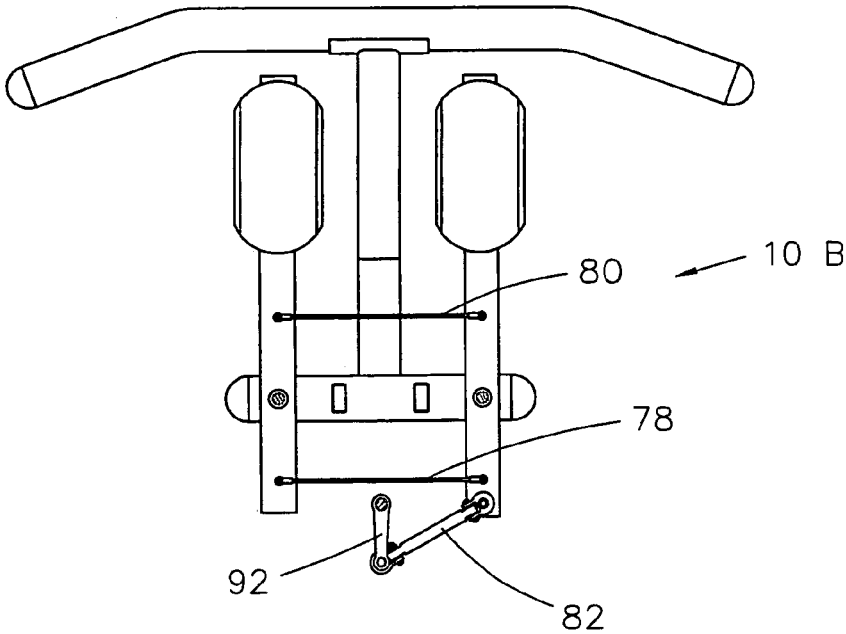
FIG. 17 is a cross-sectional view of the alternative embodiment of the skating machine illustrated in FIG. 16, as it would be seen along Line 17-17 of FIG. 16.
Figure 18:
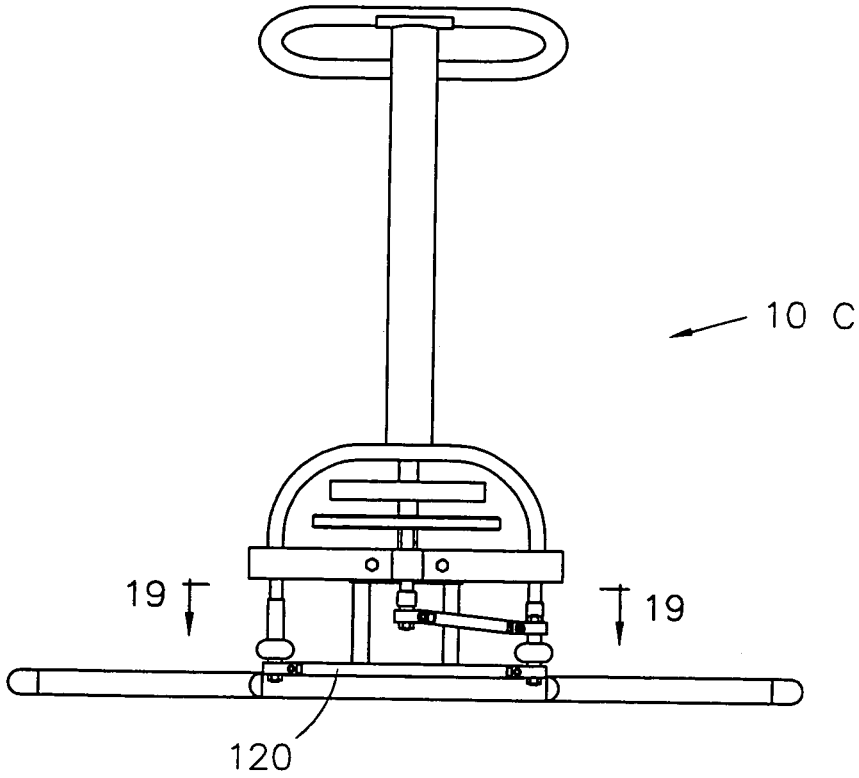
FIG. 18 is a front elevational view of another alternative embodiment of the present invention where the pair of flexible and inextensible cables in the embodiment illustrated in FIG. 16 has been replaced with a transverse rigid rod.
Figure 19:
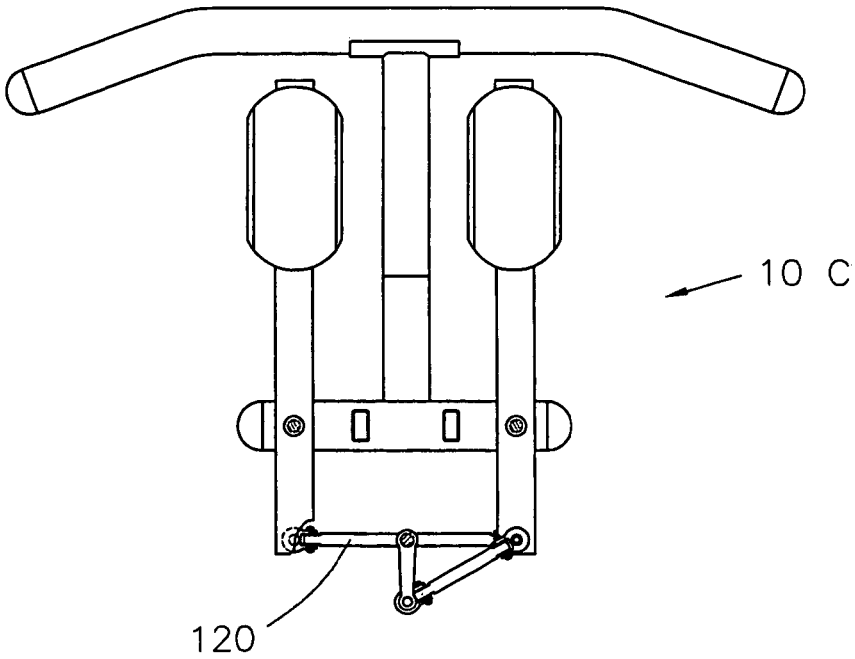
FIG. 19 is a cross-sectional view of the alternative embodiment of the skating machine illustrated in FIG. 18, as it would be seen along line 19-19 of FIG. 18.

Several more broadly described alternative embodiments of the present invention are illustrated in FIGS. 16 through 21. FIGS. 16 and 17 are intended to illustrate an alternative embodiment where the skating machine now called 10B is the same as the embodiment illustrated in FIGS. 1 through 13 but the resilient tension means 100 has been eliminated. The skating machine will work, but not as well as with the resilient tension means included. In FIGS. 16 and 17 the embodiment includes the flexible and inextensible cables 78 and 80 and once again, it will be appreciated that it is within the spirit and scope of the present invention to have at least one flexible and extensible cable, either 78 or 80, positioned anywhere along the length of the longitudinal pedal bars 32 and 42. In FIGS. 18 and 19, the flexible and inextensible cables 78 and 80 have been replaced with transverse rigid rod 120, comparable to the embodiment in FIGS. 14 and 15 but with the resilient tension means 100 also eliminated.

Figure 20:
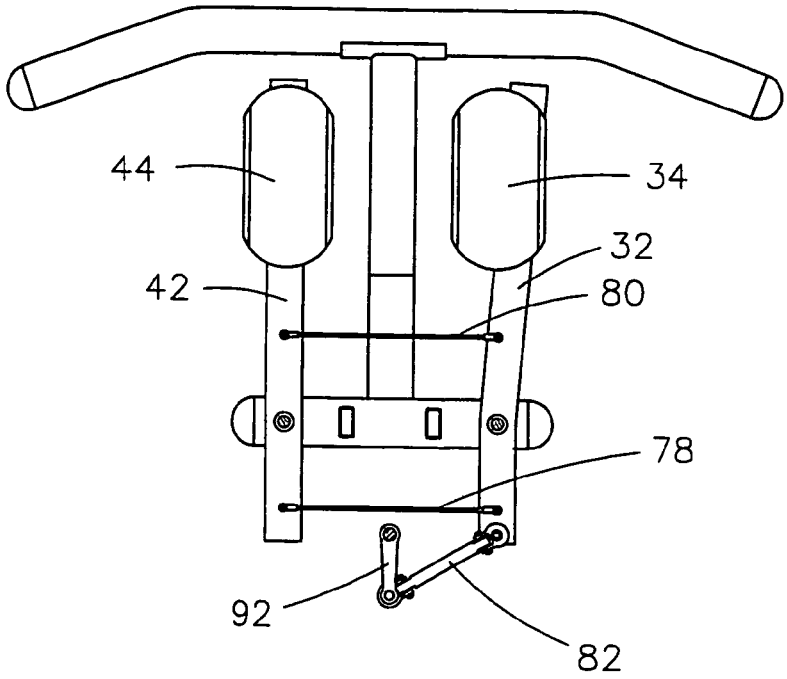
FIG. 20 is a sectional view of another alternative embodiment of the present invention skating machine where the tracks are not parallel and one track extends away from the other track.
Figure 21:
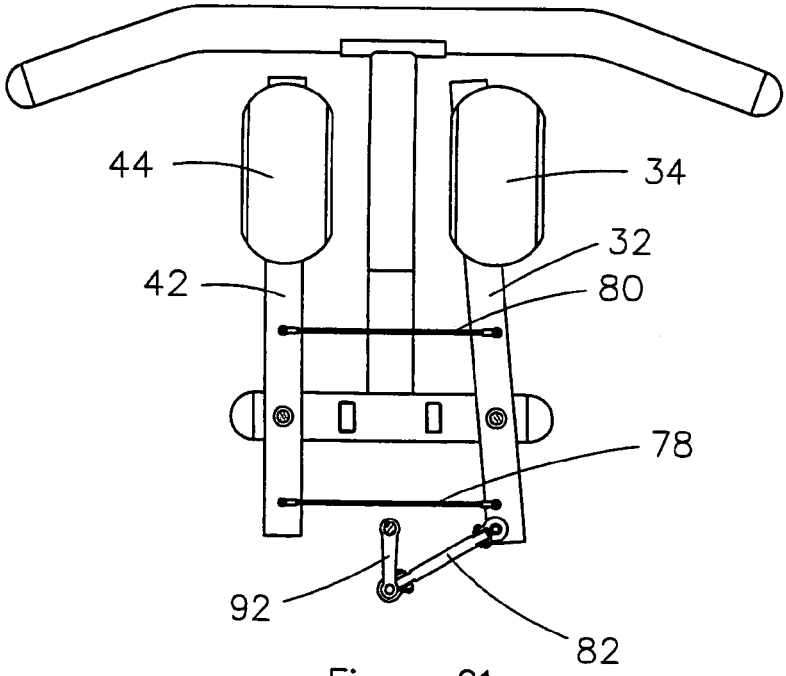
FIG. 21 is a sectional view of another alternative embodiment of the present invention skating machine where the tracks are not parallel and one track extends toward the other track.

Foot pedal assemblies 30 and 40 are side by side to each other and located along opposite sides of longitudinal frame 24. In the preferred embodiment illustrated in FIGS. 1 through 19, the foot pedal assemblies are parallel to each other. FIGS. 20 and 21 are intended to illustrate that it is also within the spirit and scope of the present invention to have embodiments where the pedal assemblies are side by side but not parallel. In the embodiment illustrated in FIG. 20, one pedal assembly extends away from the other pedal assembly. In the embodiment illustrated in FIG. 21, one pedal assembly extends toward the other pedal assembly. All of these variations are within the spirit and scope of the present invention.

Defined in detail, the present invention is a skating machine comprising: (a) a rear transverse frame, a front transverse frame and a longitudinal frame interconnecting the front and rear transverse frames; (b) a first pedal assembly further comprising a first longitudinal pedal bar having a first foot pedal attached adjacent one end and means to rotatably connect the first longitudinal pedal bar to the front transverse frame at a location between the first foot pedal and the opposite end of the first longitudinal pedal bar; (c) a second pedal assembly further comprising a second longitudinal pedal bar having a second foot pedal attached adjacent one end and means to rotatably connect the second longitudinal pedal bar to the front transverse frame at a location between the second foot pedal and the opposite end of the second longitudinal pedal bar, the first and second pedal assemblies being side-by-side to each other and located on opposite sides of the longitudinal frame; (d) a transverse frame to which is connected a semi-circular frame to which is connected a handle post to which is connected a handlebar, a rearwardly extending transverse bar connected to the longitudinal frame and a forwardly extending longitudinal bar connected to the transverse frame; (e) an axle supported on the rearwardly extending longitudinal bar to which is rotatably connected a flywheel and a pulley, a pulley axle supported on the forwardly extending longitudinal bar which is connected to a pulley wheel, the pulley wheel and the pulley of the flywheel being interconnected by a connecting band so that the pulley wheel and the flywheel rotate together; (f) a pedal connector bar rotatably connected at one end to the first longitudinal pedal bar and rotatably connected at its opposite end to a crank axle, a crank connected at one end to the crank axle and connected at its opposite end to the pulley axle; (g) a resilient tension means connected at one end to the crank axle and connected at its opposite end to a post which is attached to a portion of a frame; and (h) transverse interconnecting means transversely interconnecting the first and second longitudinal pedal bars.

Defined broadly, the present invention is a skating machine comprising: (a) a frame assembly having at least a transverse frame and a longitudinal frame; (b) a first pedal assembly having a foot pedal adjacent one end and rotatably connected to the transverse frame; (c) a second pedal assembly having a foot pedal adjacent one end and rotatably connected to the transverse frame, the first and second pedal assemblies being side-by-side and located on opposite sides of the longitudinal frame; (d) a frame assembly which supports a handlebar post and a handlebar connected thereto, the frame assembly further comprising means to support a rear axle and a front pulley axle, a flywheel and a pulley rotatably connected to the rear axle, a pulley wheel connected to the front pulley axle, the pulley wheel and the pulley of the flywheel being interconnected by a connecting band so that the pulley wheel and the flywheel rotate together; (e) a pedal connector bar rotatably connected at one end to a pedal assembly and rotatably connected at its opposite end to a crank axle, a crank connected at one end to the crank axle and connected at its opposite end to the pulley axle; (f) a resilient tension means connected at one end to the crank axle and connected at its opposite end to a portion of a frame; and (g) transverse interconnecting means transversely interconnecting the first and second pedal assemblies.

Defined more broadly, the present invention is a skating machine comprising: (a) a frame assembly having at least a transverse frame and a longitudinal frame; (b) a first pedal assembly having a foot pedal and rotatably connected to the transverse frame; (c) a second pedal assembly having a foot pedal and rotatably connected to the transverse frame, the first and second pedal assemblies being side-by-side and located on opposite sides of the longitudinal frame; (d) a frame assembly which supports a resistance means; (e) a pedal connector bar rotatably connected at one end to a pedal assembly and rotatably connected at its opposite end to a crank axle, a crank connected at one end to the crank axle and rotatably connected at its opposite end to the resistance means; (f) a resilient tension means connected at one end to the location of the interconnection of the ends of the pedal connector bar and the crank and connected at its opposite end to a portion of a frame assembly; and (g) transverse interconnecting means transversely interconnecting the first and second pedal assemblies.

Defined even more broadly, the present invention is a skating machine comprising: (a) a frame assembly having at least a transverse frame and a longitudinal frame; (b) a first pedal assembly having a foot pedal and rotatably connected to the transverse frame; (c) a second pedal assembly having a foot pedal and rotatably connected to the transverse frame, the first and second pedal assemblies being side-by-side and located on opposite sides of the longitudinal frame; (d) a frame assembly which supports a resistance means; (e) a pedal connector bar rotatably connected at one end to a pedal assembly and rotatably connected at its opposite end to a crank axle, a crank connected at one end to the crank axle and rotatably connected at its opposite end to the resistance means; and (f) transverse interconnecting means transversely interconnecting the first and second pedal assemblies.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A skating machine comprising:

a. a rear transverse frame, a front transverse frame and a longitudinal frame interconnecting the front and rear transverse frames;

b. a first pedal assembly further comprising a first longitudinal pedal bar having a first foot pedal attached adjacent one end and means to rotatably connect the first longitudinal pedal bar to the front transverse frame at a location between the first foot pedal and the opposite end of the first longitudinal pedal bar;

c. a second pedal assembly further comprising a second longitudinal pedal bar having a second foot pedal attached adjacent one end and means to rotatably connect the second longitudinal pedal bar to the front transverse frame at a location between the second foot pedal and the opposite end of the second longitudinal pedal bar, the first and second pedal assemblies being side-by-side to each other and located on opposite sides of the longitudinal frame;

d. a transverse frame to which is connected a semi-circular frame to which is connected a handle post to which is connected a handlebar, a lower rearwardly extending longitudinal bar connected to said transverse frame and a forwardly extending longitudinal bar connected to said transverse frame, and an upper rearwardly extending longitudinal bar connected to said semi-circular frame;

e. an axle supported on said upper and lower rearwardly extending longitudinal bars to which is rotatably connected a flywheel and a pulley, a pulley axle supported on said forwardly extending longitudinal bar which is connected to a pulley wheel, the pulley wheel and the pulley of the flywheel being interconnected by a connecting band so that the pulley wheel and the flywheel rotate together;

f. a pedal connector bar rotatably connected at one end to the first longitudinal pedal bar and rotatably connected at its opposite end to a crank axle, a crank connected at one end to the crank axle and connected at its opposite end to the pulley axle;

g. a resilient tension means connected at one end to the crank axle and connected at its opposite end to a post which is attached to a portion of said longitudinal frame; and h. transverse interconnecting means transversely interconnecting the first and second longitudinal pedal bars.

2. A skating machine in accordance with claim 1, wherein said resilient tension means is a bungee cord.

3. A skating machine in accordance with claim 1, wherein said transverse interconnecting means is a solid rod attached to said first and second longitudinal pedal bars.

4. A skating machine in accordance with claim 1, wherein the first and second pedal assemblies are parallel to each other.

5. A skating machine in accordance with claim 1, wherein one pedal assembly extends toward the other pedal assembly.

6. A skating machine in accordance with claim 1, wherein one pedal assembly extends away from the other pedal assembly.

7. A skating machine comprising:

a. a base frame assembly having at least a transverse frame and a longitudinal frame;

b. a first pedal assembly having a foot pedal adjacent one end and rotatably connected to said transverse frame;

c. a second pedal assembly having a foot pedal adjacent one end and rotatably connected to said transverse frame, the first and second pedal assemblies being side-by-side and located on opposite sides of the longitudinal frame;

d. a frame assembly which supports a handlebar post and a handlebar connected thereto, the frame assembly further comprising means to support a rear axle and a front pulley axle, a flywheel and a pulley rotatably connected to the rear axle, a pulley wheel connected to the front pulley axle, the pulley wheel and the pulley of the flywheel being interconnected by a connecting band so that the pulley wheel and the flywheel rotate together;

e. a pedal connector bar rotatably connected at one end to a pedal assembly and rotatably connected at its opposite end to a crank axle, a crank connected at one end to the crank axle and connected at its opposite end to the pulley axle;

f. a resilient tension means connected at one end to the crank axle and connected at its opposite end to a portion of a said longitudinal frame; and g. transverse interconnecting means transversely interconnecting the first and second pedal assemblies.

8. A skating machine in accordance with claim 7, wherein said resilient tension means is a bungee cord.

9. A skating machine in accordance with claim 7, wherein said transverse interconnecting means is a rod attached to said first and second pedal assemblies.

10. A skating machine in accordance with claim 7, wherein the first and second pedal assemblies are parallel to each other.

11. A skating machine in accordance with claim 7, wherein one pedal assembly extends toward the other pedal assembly.

12. A skating machine in accordance with claim 7, wherein one pedal assembly extends away from the other pedal assembly.

13. A skating machine comprising:

a. a base frame assembly having at least a transverse frame and a longitudinal frame;

b. a first pedal assembly having a foot pedal and rotatably connected to said transverse frame;

c. a second pedal assembly having a foot pedal and rotatably connected to said transverse frame, the first and second pedal assemblies being side-by-side and located on opposite sides of the longitudinal frame;

d. a frame assembly which supports a resistance means;

e. a pedal connector bar rotatably connected at one end to a pedal assembly and rotatably connected at its opposite end to a crank axle, a crank connected at one end to the crank axle and rotatably connected at its opposite end to said resistance means;

f. a resilient tension means connected at one end to the location of the interconnection of the ends of the pedal connector bar and the crank and connected at its opposite end to a portion of said longitudinal frame; and g. transverse interconnecting means transversely interconnecting the first and second pedal assemblies.

14. A skating machine in accordance with claim 13, wherein said resilient tension means is a bungee cord.

15. A skating machine in accordance with claim 13, wherein the opposite end of the resilient tension means is connected to a portion of the frame assembly which supports the resistance means.

16. A skating machine in accordance with claim 13, wherein said transverse interconnecting means is a rod attached to said first and second pedal assemblies.

17. A skating machine in accordance with claim 13, wherein said resistance means is a pulley wheel rotatably connected to a flywheel.

18. A skating machine in accordance with claim 13, wherein the first and second pedal assemblies are parallel to each other.

19. A skating machine in accordance with claim 13, wherein one pedal assembly extends toward the other pedal assembly.

20. A skating machine in accordance with claim 13, wherein one pedal assembly extends away from the other pedal assembly.

21. A skating machine comprising:

a. a base frame assembly having at least a transverse frame and a longitudinal frame;

b. a first pedal assembly having a foot pedal and rotatably connected to said transverse frame;

c. a second pedal assembly having a foot pedal and rotatably connected to said transverse frame, the first and second pedal assemblies being side-by-side and located on opposite sides of the longitudinal frame;

d. a frame assembly which supports a resistance means;

e. a pedal connector bar rotatably connected at one end to a pedal assembly and rotatably connected at its opposite end to a crank axle, a crank connected at one end to the crank axle and rotatably connected at its opposite end to said resistance means; and f. transverse interconnecting means which is at least one flexible and inextensible cable connected to the first and second pedal assemblies; and a resilient tension means connected at one end to the crank axle and connected at its opposite end to a post which is attached to a portion of said longitudinal frame.

22. A skating machine comprising:

a. a rear transverse frame, a front transverse frame and a longitudinal frame interconnecting the front and rear transverse frames;

b. a first pedal assembly further comprising a first longitudinal pedal bar having a first foot pedal attached adjacent one end and means to rotatably connect the first longitudinal pedal bar to the front transverse frame at a location between the first foot pedal and the opposite end of the first longitudinal pedal bar;

c. a second pedal assembly further comprising a second longitudinal pedal bar having a second foot pedal attached adjacent one end and means to rotatably connect the second longitudinal pedal bar to the front transverse frame at a location between the second foot pedal and the opposite end of the second longitudinal pedal bar, the first and second pedal assemblies being side-by-side to each other and located on opposite sides of the longitudinal frame;

d. a transverse frame to which is connected a semi-circular frame to which is connected a handle post to which is connected a handlebar, a lower rearwardly extending longitudinal bar connected to said transverse frame and a forwardly extending longitudinal bar connected to said transverse frame, and an upper rearwardly extending longitudinal bar connected to said semi-circular frame;

e. an axle supported on said upper and lower rearwardly extending longitudinal bars to which is rotatably connected a flywheel and a pulley, a pulley axle supported on said forwardly extending longitudinal bar which is connected to a pulley wheel, the pulley wheel and the pulley of the flywheel being interconnected by a connecting band so that the pulley wheel and the flywheel rotate together;

f. a pedal connector bar rotatably connected at one end to the first longitudinal pedal bar and rotatably connected at its opposite end to a crank axle, a crank connected at one end to the crank axle and connected at its opposite end to the pulley axle;

g. a resilient tension means connected at one end to the crank axle and connected at its opposite end to a post which is attached to a portion of said front transverse frame; and h. transverse interconnecting means transversely interconnecting the first and second longitudinal pedal bars.

23. A skating machine comprising:

a. a base rear transverse frame, a front transverse frame and a longitudinal frame interconnecting the front and rear transverse frames;

b. a first pedal assembly further comprising a first longitudinal pedal bar having a first foot pedal attached adjacent one end and means to rotatably connect the first longitudinal pedal bar to the front transverse frame at a location between the first foot pedal and the opposite end of the first longitudinal pedal bar;

c. a second pedal assembly further comprising a second longitudinal pedal bar having a second foot pedal attached adjacent one end and means to rotatably connect the second longitudinal pedal bar to the front transverse frame at a location between the second foot pedal and the opposite end of the second longitudinal pedal bar, the first and second pedal assemblies being side-by-side to each other and located on opposite sides of the longitudinal frame;

d. a transverse frame to which is connected a semi-circular frame to which is connected a handle post to which is connected a handlebar, a lower rearwardly extending longitudinal bar connected to said transverse frame and a forwardly extending longitudinal bar connected to said transverse frame, and an upper rearwardly extending longitudinal bar connected to said semi-circular frame;

e. an axle supported on said upper and lower rearwardly extending longitudinal bars to which is rotatably connected a flywheel and a pulley, a pulley axle supported on said forwardly extending longitudinal bar which is connected to a pulley wheel, the pulley wheel and the pulley of the flywheel being interconnected by a connecting band so that the pulley wheel and the flywheel rotate together;

f. a pedal connector bar rotatably connected at one end to the first longitudinal pedal bar and rotatably connected at its opposite end to a crank axle, a crank connected at one end to the crank axle and connected at its opposite end to the pulley axle;

g. a resilient tension means connected at one end to the crank axle and connected at its opposite end to a post which is attached to a portion of said longitudinal frame; and h. transverse interconnecting means transversely interconnecting the first and second longitudinal pedal bars wherein the transverse interconnection means is a first flexible and inextensible cable attached to the first and second longitudinal pedal bars at a location in front of the front transverse frame and a second flexible and inextensible cable attached to the first and second longitudinal pedal bars at a location in back of the first transverse frame.

24. A skating machine comprising:

a. a rear transverse frame, a front transverse frame and a longitudinal frame interconnecting the front and rear transverse frames;

b. a first pedal assembly further comprising a first longitudinal pedal bar having a first foot pedal attached adjacent one end and means to rotatably connect the first longitudinal pedal bar to the front transverse frame at a location between the first foot pedal and the opposite end of the first longitudinal pedal bar;

c. a second pedal assembly further comprising a second longitudinal pedal bar having a second foot pedal attached adjacent one end and means to rotatably connect the second longitudinal pedal bar to the front transverse frame at a location between the second foot pedal and the opposite end of the second longitudinal pedal bar, the first and second pedal assemblies being side-by-side to each other and located on opposite sides of the longitudinal frame;

d. a transverse frame to which is connected a semi-circular frame to which is connected a handle post to which is connected a handlebar, a lower rearwardly extending longitudinal bar connected to said transverse frame and a forwardly extending longitudinal bar connected to said transverse frame, and an upper rearwardly extending longitudinal bar connected to said semi-circular frame;

e. an axle supported on said upper and lower rearwardly extending longitudinal bars to which is rotatably connected a flywheel and a pulley, a pulley axle supported on said forwardly extending longitudinal bar which is connected to a pulley wheel, the pulley wheel and the pulley of the flywheel being interconnected by a connecting band so that the pulley wheel and the flywheel rotate together;

f. a pedal connector bar rotatably connected at one end to the first longitudinal pedal bar and rotatably connected at its opposite end to a crank axle, a crank connected at one end to the crank axle and connected at its opposite end to the pulley axle;

g. a resilient tension means connected at one end to the crank axle and connected at its opposite end to a post which is attached to a portion of said longitudinal frame; and h. transverse interconnecting means transversely interconnecting the first and second longitudinal pedal bars wherein the transverse interconnecting means is at least one flexible and inextensible cable attached to the first and second longitudinal pedal bars.

25. A skating machine comprising:

a. a base frame assembly having at least a transverse frame and a longitudinal frame;

b. a first pedal assembly having a foot pedal adjacent one end and rotatably connected to said transverse frame;

c. a second pedal assembly having a foot pedal adjacent one end and rotatably connected to said transverse frame, the first and second pedal assemblies being side-by-side and located on opposite sides of the longitudinal frame;

d. a frame assembly which supports a handlebar post and a handlebar connected thereto, the frame assembly further comprising means to support a rear axle and a front pulley axle, a flywheel and a pulley rotatably connected to the rear axle, a pulley wheel connected to the front pulley axle, the pulley wheel and the pulley of the flywheel being interconnected by a connecting band so that the pulley wheel and the flywheel rotate together;

e. a pedal connector bar rotatably connected at one end to a pedal assembly and rotatably connected at its opposite end to a crank axle, a crank connected at one end to the crank axle and connected at its opposite end to the pulley axle;

f. a resilient tension means connected at one end to the crank axle and connected at its opposite end to a portion of said transverse frame; and g. transverse interconnecting means transversely interconnecting the first and second pedal assemblies.

26. A skating machine comprising:

a. a base frame assembly having at least a transverse frame and a longitudinal frame;

b. a first pedal assembly having a foot pedal adjacent one end and rotatably connected to said transverse frame;

c. a second pedal assembly having a foot pedal adjacent one end and rotatably connected to said transverse frame, the first and second pedal assemblies being side-by-side and located on opposite sides of the longitudinal frame;

d. a frame assembly which supports a handlebar post and a handlebar connected thereto, the frame assembly further comprising means to support a rear axle and a front pulley axle, a flywheel and a pulley rotatably connected to the rear axle, a pulley wheel connected to the front pulley axle, the pulley wheel and the pulley of the flywheel being interconnected by a connecting band so that the pulley wheel and the flywheel rotate together;

e. a pedal connector bar rotatably connected at one end to a pedal assembly and rotatably connected at its opposite end to a crank axle, a crank connected at one end to the crank axle and connected at its opposite end to the pulley axle;

f. a resilient tension means connected at one end to the crank axle and connected at its opposite end to a portion of said longitudinal frame; and g. transverse interconnecting means transversely interconnecting the first and second pedal assemblies wherein the transverse interconnecting means is a first flexible and inextensible cable attached to the first and second pedal assemblies at a location in front of the transverse frame and a second flexible and inextensible cable attached to the first and second pedal assemblies at a location in back of the transverse frame.

27. A skating machine comprising:

a. a base frame assembly having at least a transverse frame and a longitudinal frame;

b. a first pedal assembly having a foot pedal adjacent one end and rotatably connected to said transverse frame;

c. a second pedal assembly having a foot pedal adjacent one end and rotatably connected to said transverse frame, the first and second pedal assemblies being side-by-side and located on opposite sides of the longitudinal frame;

d. a frame assembly which supports a handlebar post and a handlebar connected thereto, the frame assembly further comprising means to support a rear axle and a front pulley axle, a flywheel and a pulley rotatably connected to the rear axle, a pulley wheel connected to the front pulley axle, the pulley wheel and the pulley of the flywheel being interconnected by a connecting band so that the pulley wheel and the flywheel rotate together;

e. a pedal connector bar rotatably connected at one end to a pedal assembly and rotatably connected at its opposite end to a crank axle, a crank connected at one end to the crank axle and connected at its opposite end to the pulley axle;

f. a resilient tension means connected at one end to the crank axle and connected at its opposite end to a portion of said longitudinal frame; and g. transverse interconnecting means interconnecting the first and second pedal assemblies wherein the transverse interconnecting means is at least one flexible and inextensible cable connected to the first and second pedal assemblies.

28. A skating machine comprising:

a. a base frame assembly having at least a transverse frame and a longitudinal frame;

b. a first pedal assembly having a foot pedal and rotatably connected to said transverse frame;

c. a second pedal assembly having a foot pedal and rotatably connected to said transverse frame, the first and second pedal assemblies being side-by-side and located on opposite sides of the longitudinal frame;

d. a frame assembly which supports a resistance means;

e. a pedal connector bar rotatably connected at one end to a pedal assembly and rotatably connected at its opposite end to a crank axle, a crank connected at one end to the crank axle and rotatably connected at its opposite end to said resistance means;

f. a resilient tension means connected at one end to the location of the interconnection of the ends of the pedal connector bar and the crank and connected at its opposite end to said transverse frame; and g. transverse interconnecting means transversely interconnecting the first and second pedal assemblies.

29. A skating machine comprising:

a. a base frame assembly having at least a transverse frame and a longitudinal frame;

b. a first pedal assembly having a foot pedal and rotatably connected to said transverse frame;

c. a second pedal assembly having a foot pedal and rotatably connected to said transverse frame, the first and second pedal assemblies being side-by-side and located on opposite sides of the longitudinal frame;

d. a frame assembly which supports a resistance means;

e. a pedal connector bar rotatably connected at one end to a pedal assembly and rotatably connected at its opposite end to a crank axle, a crank connected at one end to the crank axle and rotatably connected at its opposite end to said resistance means;

f. a resilient tension means connected at one end to the location of the interconnection of the ends of the pedal connector bar and the crank and connected at its opposite end to a portion of said longitudinal frame; and g. transverse interconnecting means transversely interconnecting the first and second pedal assemblies, wherein the transverse interconnecting means is a first flexible and inextensible cable attached to the first and second pedal assemblies at a location in front of the transverse frame and a second flexible and inextensible cable attached to the first and second pedal assemblies at a location in back of the transverse frame.

30. A skating machine comprising:

a. a base frame assembly having at least a transverse frame and a longitudinal frame;

b. a first pedal assembly having a foot pedal and rotatably connected to said transverse frame;

c. a second pedal assembly having a foot pedal and rotatably connected to said transverse frame, the first and second pedal assemblies being side-by-side and located on opposite sides of the longitudinal frame;

d. a frame assembly which supports a resistance means;

e. a pedal connector bar rotatably connected at one end to a pedal assembly and rotatably connected at its opposite end to a crank axle, a crank connected at one end to the crank axle and rotatably connected at its opposite end to said resistance means;

f. a resilient tension means connected at one end to the location of the interconnection of the ends of the pedal connector bar and the crank and connected at its opposite end to a portion of said longitudinal frame; and g. transverse interconnecting means transversely interconnecting the first and second pedal assemblies, wherein the transverse interconnecting means is at least one flexible and inextensible cable connected to the first and second pedal assemblies.

* * * * *